US005469911A

United States Patent [19]

Parker

[11] Patent Number: 5,469,911

[45] Date of Patent: Nov. 28, 1995

[54] METHOD FOR IMPROVING SURFACE QUALITY OF ELECTROMAGNETICALLY CAST ALUMINUM ALLOYS AND PRODUCTS THEREFROM

[75] Inventor: Gary B. Parker, Moulton, Ala.

[73] Assignee: Reynolds Metals Company, Richmond, Va.

[21] Appl. No.: 226,727

[22] Filed: Apr. 12, 1994

[51] Int. Cl.[6] ..... B22D 11/00; B22D 27/02

[52] U.S. Cl. ..... 164/467; 164/459; 164/473; 164/487

[58] Field of Search ..... 164/467, 503, 164/487, 459, 473

[56] References Cited

U.S. PATENT DOCUMENTS

| | | |
|---|---|---|
| 3,779,389 | 12/1973 | Fant . |
| 3,926,690 | 12/1975 | Morris et al. . |
| 4,009,026 | 2/1977 | Rasmessen . |
| 4,138,275 | 2/1979 | Yokota et al. . |
| 4,377,425 | 3/1983 | Otani et al. . |
| 4,450,136 | 5/1984 | Dudek et al. . |
| 4,523,627 | 6/1985 | Cans et al. . |
| 4,650,528 | 3/1987 | Masumoto et al. . |
| 4,929,511 | 5/1990 | Bye, Jr. et al. . |

OTHER PUBLICATIONS

L. J. Matienzo, "Surface reactions of ammonium fluoroborate with aluminum alloys", Aluminum English, 11 vol. 59, 1983, pp. 453–457.

M. Drouzy and C. Mascre, "The oxidation of liquid non–ferrous metals in air or oxygen", Metallurgical Reviews, Review 131, pp. 25–46.

*Primary Examiner*—Kuang Y. Lin

*Attorney, Agent, or Firm*—Alan M. Biddison

[57] ABSTRACT

A method for improving the surface quality of electromagnetically cast aluminum alloy ingot includes the addition of an effective amount of calcium prior to the ingot head of an ingot mold of an electromagnetic casting station. The addition of calcium is regulated such that the aluminum alloy cast ingot contains a maximum of 0.05 weight percent calcium. Addition of the calcium prior to the ingot head produces a cast ingot which is generally free of surface imperfections on side surfaces thereof so that the cast ingot can be directly worked or rolled to a desired gauge without a scalping or surface conditioning treatment. The calcium can be added during melting, alloying, filtering, degassing or transferring of the molten aluminum prior to casting. An electromagnetically cast aluminum alloy ingot is produced, preferably an AA5182 can end stock alloy, which is essentially free of surface imperfections to permit direct rolling or other working of the cast ingot without a surface conditioning treatment.

12 Claims, 1 Drawing Sheet

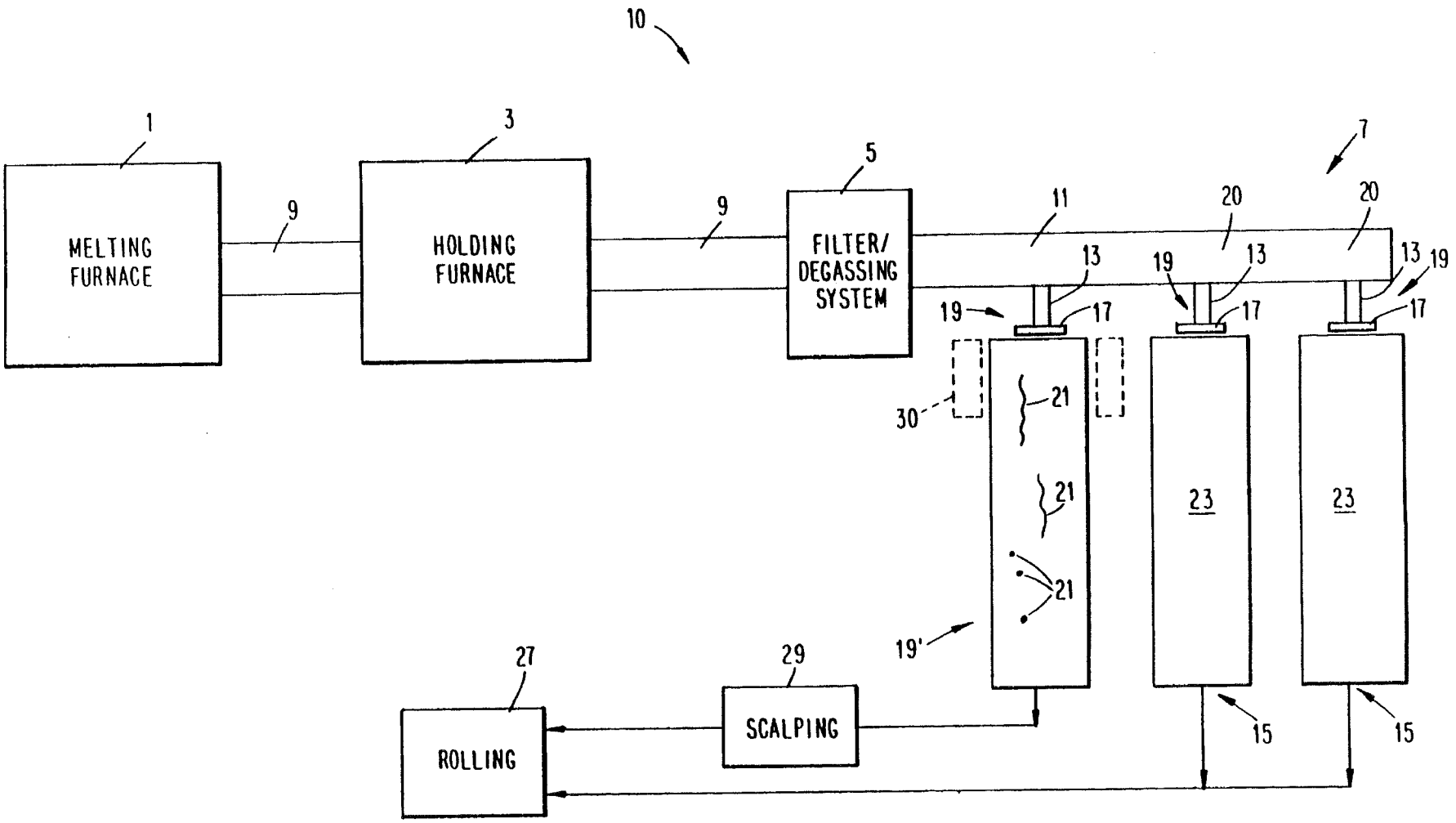
MELTING FURNACE
HOLDING FURNACE
FILTER/ DEGASSING SYSTEM
SCALPING
ROLLING
1
3
5
7
9
9
10
11
13
13
13
15
15
17
17
17
19
19
19
19'
20
20
21
21
21
23
23
27
29
30'

METHOD FOR IMPROVING SURFACE QUALITY OF ELECTROMAGNETICALLY CAST ALUMINUM ALLOYS AND PRODUCTS THEREFROM

FIELD OF THE INVENTION

The present invention is directed to a method for improving the surface quality of electromagnetically cast aluminum alloys and, in particular, to the addition of calcium to the molten aluminum prior to the ingot head during electromagnetic casting.

BACKGROUND ART

In the production of aluminum alloy products, aluminum is melted, alloyed and cast into ingots which are then subjected to a variety of working operations such as rolling, extruding, milling, etc. Processes used for casting aluminum alloy ingots include direct chill continuous casting and electromagnetic casting.

In direct chill casting, molten aluminum is poured into a shallow water-cooled mold of a desired cross-sectional shape to form an ingot. When the metal begins to freeze in the mold, a false bottom in the mold is lowered at a controlled rate and water is sprayed on the surface of the freshly solidified metal as it comes out of the mold.

In electromagnetic casting, molten aluminum is fed to a mold and confined by electromagnetic forces therein. The molten aluminum is solidified and withdrawn from the mold to form a cast ingot.

A particular concern involved in the process of continuous casting aluminum alloys into ingots is avoiding the formation of metal oxides and preventing slag, dross or other impurities from entering the ingot mold to adversely effect the surface quality of the ingot being cast. Surface imperfections in the ingot sidewalls result in higher operating costs since the cast ingots require surface treatment such as scalping or the like to remove surface imperfections before further working is done.

The prior art has proposed various solutions to improve the cast surface quality of aluminum alloys. U.S. Pat. No. 3,779,389 discloses a bag-shaped filter which is designed to remove solid contaminants from aluminum during casting. The bag-shaped filter is arranged in the ingot head to filter solid particulate material from the molten metal.

U.S. Pat. No. 3,926,690 discloses an aluminum-iron-silicon alloy having strontium and/or calcium as an alloying component thereof to reduce pickup during the extrusion of a cast ingot.

U.S. Pat. No. 4,523,627 discloses an electromagnetic casting method characterized by the use of a top feeder head in combination with an electromagnetic field. Controlling the position of the height of the top feeder head and the casting cooling system permits casting of aluminum and alloys thereof in the form of billets or plates which have surfaces that do not require any scalping treatment.

However, conventional continuous casting of aluminum alloys into ingot form does not consistently provide an acceptable surface quality on the cast ingots such that the cast ingots can be directly worked without the need for scalping or other surface treatment. In particular, the production of can body stock alloys, such as AA3104, and can end stock alloys, such as AA5182, require a high quality ingot surface before further working is performed. Aluminum alloys of the AA5000 series, such as AA5182, are particularly difficult to electromagnetically cast without producing significant surface imperfections in the ingot surface requiring scalping treatment. It is believed that the presence of magnesium oxide in the vicinity of the ingot surface during casting is a primary component that contributes to poor surface quality in the as-cast product.

In view of the deficiencies in the prior art discussed above, a need has developed to provide an improved electromagnetic casting process for aluminum and aluminum alloys which produces an ingot product having a surface quality sufficient to permit further working of the cast ingot without the need for a surface treatment such as scalping or the like.

In response to this need, the present invention provides an improved electromagnetic casting process which produces a cast aluminum or aluminum alloy ingot having an ingot surface quality which is generally free of surface imperfections. The cast ingot can be directly worked, rolled or reduced in size without the need for a surface conditioning or scalping operation.

SUMMARY OF THE INVENTION

Accordingly, it is a first object of the present invention to provide a method for improving the surface quality of electromagnetically cast aluminum alloys and products therefrom.

It is a further object of the present invention to provide an improved electromagnetic casting process that produces a high surface quality cast ingot by treating the molten aluminum alloy to be cast prior to the ingot head of the electromagnetic casting station.

Another object of the present invention is to provide an electromagnetically cast aluminum alloy ingot having at least the side surfaces thereof generally free of surface imperfections such that the cast ingot can be directly worked without surface conditioning or scalping.

Other objects and advantages of the present invention will become apparent as a description thereof proceeds.

In satisfaction of the foregoing objects and advantages, the present invention is an improvement over conventional electromagnetic casting of aluminum alloys into ingot product. During electromagnetic casting of aluminum alloys, a molten aluminum alloy, preferably a AA5000 series alloy, is fed to an ingot mold in the vicinity of an ingot head thereof and is confined by electromagnetic forces within the ingot mold. In accordance with the inventive method, an effective amount of calcium is added to the molten aluminum alloy prior to the ingot head and an aluminum alloy ingot is cast having a side surface quality sufficiently free of surface imperfections such that the aluminum alloy ingot can be reduced in size by working without a surface conditioning operation to the ingot side surfaces.

More preferably, the calcium is added during electromagnetic casting such that the cast aluminum alloy ingot contains no more than 0.05 weight percent calcium. In a preferred embodiment, the aluminum alloy electromagnetically cast is a AA5000 series alloy and, more preferably, an AA5182 aluminum alloy with between 0.01 and 0.04 weight percent calcium.

By the inventive method, an electromagnetically cast ingot is provided, preferably an AA5000 series type aluminum alloy, having side surfaces generally free of surface imperfections. The cast ingot, containing an effective amount of calcium, can be further reduced in size by working without a surface conditioning treatment between the electromagnetic casting of the ingot and working of the cast ingot.

BRIEF DESCRIPTION OF THE DRAWINGS

Reference is now made to the accompanying drawing wherein the sole FIGURE is a schematic block flow diagram depicting the inventive method.

DESCRIPTION OF THE PREFERRED EMBODIMENTS

The present invention provides unexpected advantages over other conventional electromagnetic casting of aluminum or aluminum alloys into ingot form. That is, by practicing the invention, an aluminum alloy ingot can be cast having a surface quality sufficiently free of surface imperfections such that the cast ingot can be subsequently reduced in size by working without the need for a surface conditioning treatment such as scalping or the like.

The inventive method is especially effective for AA5000 series aluminum alloys and in particular, aluminum can end stock, AA5182. These types of aluminum alloys are particularly troublesome when electromagnetically cast due to the tendency of impurities in the molten aluminum to be incorporated in the ingot cast surface. The present invention eliminates this drawback by treating the aluminum alloy prior to the ingot head.

With reference now to the sole FIGURE a schematic flow diagram of the inventive electromagnetic casting process and apparatus is generally designated by the reference numeral 10 and includes a melting furnace 1, holding furnace 3, filter/degassing system 5 and casting station 7. Transfer devices 9 are provided between the melting and holding furnaces and the filter/degassing system. A pouring pan or trough 11 feeds the molten aluminum alloy from the filter/degassing system to the casting station 7.

The casting station 7 includes a plurality of downspouts 13. The downspouts 13 feed molten aluminum alloy via the distributors 17 to the electromagnetic casting apparatus 30 (one shown for purposes of clarity). It should be understood that the electromagnetic casting apparatus for use with the inventive method is conventional in nature and a further detailed description is not deemed necessary for understanding of the invention.

The electromagnetic casting apparatus produces ingots 15 of specified shape. Ingots are intended to encompass all shapes capable of being cast using electromagnetic casting techniques.

The calcium to be added to the molten aluminum alloy can be any known type such as particulate, briquette, powder, bricks or other forms. The calcium is intentionally added to the molten aluminum in a metered fashion prior to the ingot head. For example, a screw feeder-type system may be employed to add the effective amount of calcium during casting. Alteratively, the calcium can be added manually by an operator in predetermined amounts.

An effective amount of calcium is intended to represent an amount of calcium when added to the molten aluminum alloy so that the aluminum alloy ingot 15 has a maximum of 0.05 weight percent calcium, preferably between 0.01 and 0.04 weight percent, more preferably an amount not exceeding 0.02 weight percent. The addition of the calcium can also be controlled by monitoring the calcium level in the molten aluminum alloy to be cast or the aluminum alloy ingot to regulate the amount of calcium to be added.

The calcium can be added at any point in the flow diagram depicted in the sole FIGURE prior to the ingot head area 19. For example, the calcium can be added to either of the furnaces 1 or 3 or in a transfer device or pouring trough. In this manner, the calcium is effectively alloyed and distributed in the molten metal prior to entering the ingot mold in order to improve the cast ingot surface quality.

In the casting station 7, one ingot is shown without the benefit of calcium addition during casting. This ingot, identified by reference numeral 15', exhibits surface imperfections 21 which can take the form of creases, pimples, oxide patches or the like. Calcium was added to the pouring pan 11 at reference numeral 20, prior to the ingot head, for ingots 15. Ingots 15 cast according to the invention produce an ingot surface 23 essentially free of any surface imperfections. With this high quality surface 23, the ingots 15 can be subsequently worked by rolling 27 or other forming operations without surface treatment. In contrast, the ingot 15' must be surfaced conditioned by scalping 29 or other treatment to remove the surface imperfections 21.

Experimental trials casting AA5000 series type alloys have produced aluminum alloy cast ingots which do not require any scalping prior to further reduction. An aluminum alloy of this type was selected to investigate the effect of calcium addition during electromagnetic casting. Two ingots of the aluminum alloy were cast, one ingot including an addition of 0.04 percent calcium to the molten alloy to be cast. The surfaces and microstructures of the cast ingots were compared to determine the effect of the calcium addition. There were no apparent differences in microstructures between the calcium-containing ingot and an ingot cast according to conventional procedures. Moreover, the as-cast surface of the calcium-containing ingot lacked wrinkles or mini-creases which are typical in these types of aluminum alloy when conventionally cast. Similar results were obtained in experiments conducted using an AA5182 alloy.

Although the actual mechanism which causes the unexpected improvement in ingot surface quality is not known, the mechanism is thought to be associated with a reduction in the surface tension and/or a change in morphology of the oxide film present during electromagnetic casting when calcium is present in the molten aluminum alloy.

As such, an invention has been disclosed in terms of preferred embodiments thereof which fulfills each and every one of the objects of the present invention as set forth hereinabove and provides a new and improved method for improving the surface quality of electromagnetically cast aluminum alloy ingot and products therefrom.

Various changes, modifications and alterations from the teachings of the present invention may be contemplated by those skilled in the art without departing from the intended spirit and scope thereof. Accordingly, it is intended that the present invention only be limited by the terms of the appended claims.

What is claimed is:

1. In a method of producing an AA5000 series aluminum alloy product comprising feeding a molten AA5000 series aluminum alloy to an ingot mold having an ingot head, electromagnetically casting the AA5000 series aluminum alloy using electromagnetic forces to confine the molten aluminum within said ingot mold, solidifying the molten aluminum to form an aluminum alloy ingot, and working said ingot to produce a product, the improvement comprising adding an effective amount of calcium to said molten aluminum alloy prior to said ingot head so that the ingot has at least an ingot side surface quality sufficiently free of surface imperfections such that said aluminum alloy ingot can be reduced in size by working without surface conditioning of said ingot side surfaces between said casting and said working steps.

2. The method of claim 1 wherein the step of adding said effective amount of calcium provides an amount of calcium in said aluminum alloy ingot not greater than 0.05 weight percent.

3. The method of claim 2 wherein said calcium amount ranges between 0.01 and 0.04 weight percent.

4. The method of claim 2 wherein said calcium amount is not greater than 0.02 weight percent.

5. The method of claim 1 wherein an AA5182 aluminum alloy is electromagnetically cast.

6. The method of claim 1 wherein said calcium is added during melting of said aluminum alloy.

7. The method of claim 1 wherein said calcium is added after melting of said aluminum alloy.

8. The method of claim 1 wherein said aluminum alloy ingot is worked directly after said casting without any surface conditioning.

9. The method of claim 6 wherein said calcium amount ranges between 0.01 and 0.04 weight percent.

10. The method of claim 5 wherein said calcium amount ranges between 0.01 and 0.04 weight percent.

11. The method of claim 5 wherein said aluminum alloy ingot is worked directly after said casting without any surface conditioning.

12. In a method of producing an AA5000 series aluminum alloy product comprising feeding a molten AA5000 series aluminum alloy to an ingot mold having an ingot head, electromagnetically casting the AA5000 series aluminum alloy using electromagnetic forces to confine the molten aluminum within said ingot mold, solidifying the molten aluminum to form an aluminum alloy ingot, and working said ingot to produce a product, the improvement comprising adding an effective amount of calcium to said molten aluminum alloy prior to said ingot head so that the ingot has at least an ingot side surface quality sufficiently free of surface imperfections such that said aluminum alloy ingot can be reduced in size by rolling without surface scalping of said ingot side surfaces between said casting and said working steps.

* * * * *